US007178182B2

(12) United States Patent
Brenner et al.

(10) Patent No.: US 7,178,182 B2
(45) Date of Patent: Feb. 20, 2007

(54) SUSPENDED SLEEPING BAG

(76) Inventors: Rainer Brenner, Karl-Danner-Strasse 30, 97340 Segnitz (DE); Ralph Singler, Altenbergstr 25, 97340 Marktbreit (DE)

( * ) Notice: Subject to any disclaimer, the term of this patent is extended or adjusted under 35 U.S.C. 154(b) by 0 days.

(21) Appl. No.: 10/548,165

(22) PCT Filed: Apr. 30, 2004

(86) PCT No.: PCT/EP2004/004596

§ 371 (c)(1),
(2), (4) Date: Sep. 6, 2005

(87) PCT Pub. No.: WO2004/095978

PCT Pub. Date: Nov. 11, 2004

(65) Prior Publication Data

US 2006/0185085 A1 Aug. 24, 2006

(30) Foreign Application Priority Data

May 2, 2003 (EP) ..... 03009983

(51) Int. Cl.
*A45F 3/22* (2006.01)

(52) U.S. Cl. ..... 5/413 R; 5/120; 5/122

(58) Field of Classification Search ..... 5/120–123, 5/413 R
See application file for complete search history.

(56) References Cited

U.S. PATENT DOCUMENTS 717,119 A * 12/1902 Potter ..... 5/122
2,694,208 A 11/1954 Christensen
3,675,256 A 7/1972 Tallarico et al.
4,001,902 A 1/1977 Hall et al.
4,021,868 A * 5/1977 Fueslein ..... 5/123
4,125,909 A * 11/1978 Jacobson ..... 5/121
7,020,915 B1 * 4/2006 Helsdon ..... 5/121

FOREIGN PATENT DOCUMENTS

FR 374442 6/1907
FR 974722 2/1951

* cited by examiner

*Primary Examiner*—Michael Trettel
(74) *Attorney, Agent, or Firm*—Pandiscio & Pandiscio

(57) ABSTRACT

The invention relates to a suspended sleeping bag comprising upper and lower parts and fixing elements which are arranged on the foot and head ends thereof, thereby making it is possible to fix at two points which are distant with respect to each other and embodied in the form of a rope, strap, ribbon, a cut fabric strip or a strip of another tensile strength material. The lower part, in contrast to the upper part, absorbs tensile forces in a longitudinal direction and leads them to the fixing points along the lines which radially converge in the area of an assembly point or fixing point, respectively. According to said invention, the lower part of the sleeping bag is tailored and/or along the length thereof or the form of the cuts of the fixing elements are dimensioned in such a way that a line which extends along the periphery of the lower part of said sleeping bag from one fixing point to the other is shorter than a line extending (roughly) to a center or crossing the lower part of the sleeping bag therebetween.

18 Claims, 2 Drawing Sheets

SUSPENDED SLEEPING BAG

The invention is directed to a suspended sleeping bag with a top and a bottom section and with attaching elements at the head and foot ends for attachment at two mutually spaced apart attachment points, particularly in the form of ropes, cords, tapes, pieces cut from a web of fabric, or another, tear-resistant material, the bottom section, unlike the top section, absorbing tensile forces in the longitudinal direction of the suspended sleeping bag and conveying them to the attachment points along lines that converge in an approximately ray-like manner in the region of one or the other of the gathering or attachment points.

Ordinary commercial sleeping bags are intended to be used on the ground or, in the best case, on an underlay such as a blanket, air mattress or thermally insulating pad. This requires, on the one hand, a comparatively large, flat area, which often is not available on outdoor treks and even in the best case makes for a relatively hard and uncomfortable bed. Furthermore, a sleeper lying on the ground out of doors is exposed to an extremely wide variety of environmental influences, particularly dampness, for example due to hoarfrost or dew, and wetness, for example due to puddles when there has been a rain. In addition, he may not feel safe from ground-dwelling insects and other relatively small animals.

German Utility Patent GM[1] 80 25 519 therefore discloses a suspended sleeping bag that can be suspended like a hammock between two attachment points. This sleeping bag can therefore theoretically be used even in the absence of a flat area, and there is scarcely any way for ground-dwelling animals to get to the bag. On the other hand, the described design shows instability, insofar as two tensioners are used at the head end and at the foot end, these being gathered are together at an eye and each connected to a respective end of a spreader bar disposed one at each end of the sleeping bag. This attachment method has proven unstable in practice, insofar as any lateral displacement of the center of gravity of a sleeper lying in the sleeping bag triggers a tipping movement of the suspended sleeping bag about its longitudinal direction, since the sleeper's center of gravity can thereby assume a lower position. The tipping movement causes increasing lateral displacement of the sleeper, which does not come to an end until the spreader bars are roughly vertical or—if the top section of the sleeping bag is very wide—the top and bottom sections of the sleeping bag have actually switched positions.

U.S. Pat. No. 4,001,902 discloses a suspended sleeping bag in which the bottom section of the sleeping bag assumes a nearly flat position owing to two spreader bars provided at its two ends. The center of gravity of a sleeper lying thereon is so high that a labile equilibrium is established, that is, when swayed slightly the suspended sleeping bag has a tendency to overturn. This is, at most, prevented by stabilizing ropes on the top side that carry a tent roof whose sides are in turn connected to the edge of the bottom section of the sleeping bag.

The arrangement described in U.S. Pat. No. 3,675,256 suffers from a similar stability problem. Here again, a suspended sleeping bag is disclosed that comprises spreader bars and is unstable because of them. To prevent overturning, according to the teaching of this prior invention the attaching ropes at one end can be run to two attachment points that are offset from each other laterally and must therefore be set at a horizontal distance from each other. However, this limits the usability of the arrangement to cases in which a sufficiently large number of attachment points is available.

These disadvantages of the described prior art give rise to the problem initiating the invention, that of creating a suspended sleeping bag in which a sleeper assumes a stable position. It would be additionally advantageous if the sleeping position were as horizontal, i.e. flat, as possible.

The solution to this problem is achieved by the fact that the bottom section of the sleeping bag is so cut to shape and/or the length or cut shape of the attaching elements is so dimensioned, that a line extending along the periphery of the bottom section of the sleeping bag from one attachment point to the other is shorter than a line extending (roughly) centrally along or through the bottom section of the sleeping bag between these points.

What is achieved in this way is that the bottom section of the sleeping bag in the suspended state assumes a sharply incurvated or sagging contour transversely to its longitudinal direction. This is because the shortened periphery of the bottom section of the sleeping bag forces it follow a much straighter path between the attachment points than its middle section. Hence, the (central) transverse radius of curvature of the bottom section of the sleeping bag is smaller in any cross-sectional plane, i.e. even in the center of the suspended sleeping bag, than the distance of the lowest-lying region of the hammock from a straight connecting line between the two attachment points. The center of gravity of a person lying on the bottom section of the sleeping bag is therefore lower roughly in the region of the vertical connecting plane between the two attachment points than in the region of the longitudinal edges, and is therefore stable against lateral tipping movements.

In the case of the inventive suspended sleeping bag, provided at the head and foot ends are attaching ropes, or another, flat attaching element, which converge in the region of a gathering point, thus creating at that location the head or foot of a (virtual) tip axis about which even the inventive suspended sleeping bag could pivot. It does not do so, however, since when such a tipping movement occurs, the center of gravity of the sleeper cannot assume a lower position; rather, the lowest possible position assumed by the center of gravity is on his plane of symmetry. This is because any movement of the body of a sleeping person away from this position of stable equilibrium generates an oppositely directed force that urges the sleeper back into the safe central position. Thus, even during restless sleep a person can never fall out of the inventive suspended sleeping bag.

The length condition necessary for this purpose and essential for small transverse curvatures can be attained either by suitably cutting to shape the bottom section of the sleeping bag and/or flat attaching means or via suitably selected lengths for the tensioners acting on various regions of the sleeping bag. The gravitational forces acting two-dimensionally on the bottom section are gathered together and conveyed along or through the bottom section and through thereto-connected attaching elements to the attachment points.

Due to their flexibility, ordinary rope-shaped attaching elements orient themselves in the direction of the tensile forces being transmitted and thereby indicate the path of these forces. The effect of adhering to the above length inequality is that when the suspended sleeping bag tips to one side, only still-shorter attaching ropes, longitudinal gores or the like of the bottom section of the sleeping bag are available at what then becomes the lowest point, and these permit even less of a longitudinal curvature and therefore raise the sleeper's center of gravity. The sleeping bag will then spontaneously return to its original position, since this allows the sleeper's center of gravity to sink again. Whereas the length of the attaching ropes or other tensioners can be influenced directly, if for example the head and foot tensioners are not connected to each other then the lengths of the requisite lines extending along the bottom section of the sleeping bag can be manipulated by means of an appropriate blank for this section. It may be advantageous in this case to have the length of the blank for the bottom section of the sleeping bag decrease toward its lateral edges.

It has proven favorable for the lines along which the longitudinal tensile forces are conveyed to the attachment points to converge in an approximately ray-like manner in the region of one or the other of the gathering points and to extend roughly free of bends and undulations between these gathering points. This measure makes it easier to preserve the above length inequality, and a path of this kind is made possible in particular if the lines concerned extend solely through pliable material and/or along equally pliable ropes.

In addition, all these measures in concert result in the obtainment of a horizontal lying position in the longitudinal direction of the suspended sleeping bag and optimize comfort and safety in getting in and out.

The top section of the sleeping bag has no bearing on any of these considerations, since it has no force-transmitting function and, moreover, for the most part does not even extend as far as the attachment points or attaching means.

It is within the scope of the invention that the bottom section of the sleeping bag is so cut to shape and/or the length or cut shape of the attaching elements is so dimensioned that between the periphery of the bottom section of the sleeping bag and its center line extending in the longitudinal direction of the suspended sleeping bag there is a line with no bends or undulations, extending along or through the bottom section of the sleeping bag from one attachment point to the other, which is the same length as or longer than all other lines extending along or through the bottom section of the sleeping bag between these points, particularly longer than the lines extending along the longitudinal center line and along the periphery of the bottom section of the sleeping bag. Two such longest lines or longest regions are disposed mirror-symmetrically to the longitudinal center plane of the suspended sleeping bag and divide the bottom section of the sleeping bag into a middle region disposed therebetween and two laterally adjacent, peripheral marginal or lateral strips. Dimensioning of this kind has, on the one hand, the result that a reclining area is created near the longitudinal center plane of the suspended sleeping bag that has less of a downward curvature, i.e. is flatter, in the transverse direction; on the other hand, the peripheral marginal or lateral strips extend relatively steeply, roughly like the sides of a boat. These marginal or lateral strips extend at their top edge all the way to the periphery of the bottom section of the sleeping bag. They form a high wall that a sleeper cannot inadvertently get over.

The flat region enclosed by the two roughly mutually symmetrical, longest regions of the bottom section of the sleeping bag preferably has a roughly spindle-like (cut) shape adapted to the human body. This region, preferably made from a flat blank, consistently gives the sleeper roughly the amount of lateral clearance needed in any cross-sectional plane. There is consequently no need to involve material from the peripheral regions, and the lateral marginal strips can have a roughly constant width over considerable lengths. The bottom section of the sleeping bag is thus given a gentle, uniform longitudinal curvature, resulting in a relatively flat and therefore comfortable sleeping position.

Adaptation to the shape of the human body has the effect that the middle region of the bottom section of the sleeping bag serving as the reclining area has at least regionally convex longitudinal edges and/or has its broadest point roughly at the height of a sleeper's shoulders, i.e. in the "head half" of the suspended sleeping bag. The term "middle section" in this context refers to the actual reclining area of a sleeping person, as opposed to the adjacent marginal or lateral regions bounding the reclining area.

An advantageous improvement of the invention is to provide at either or each of the head and foot ends a roughly trapezoidally tapered cut shape made of a tear-resistant material, whose broader main face is disposed on the region serving as a sleeping bag and whose narrower face is provided with an attaching means, for example a rope, hook or eye. Such an attaching means can, for example, be fastened by means of a zipper to the bottom section of the sleeping bag and thus removed with few manipulations when the bag is used as an on-the-ground sleeping bag. Or it can be implemented as a pocket to receive the folded-up suspended sleeping bag.

In development of the inventive idea, it is provided that the blank for the bottom section of the sleeping bag, in the region of its periphery, particularly laterally adjacent to and thus outward from each of the longitudinal edges of the middle section roughly corresponding to the reclining area, comprises or is connected to, particularly sewn to, at least one marginal or lateral strip whose outer, i.e. peripheral, boundary follows a concave path. This initially concave marginal region, which follows a continuous line of force when the suspended sleeping bag is in use, enables the middle section then to assume a sharply incurvate shape between the head and foot ends without being overstretched in individual regions. The use shape of the inventive suspended sleeping bag is most aptly compared to a gondola, the bottom of which (corresponding to the middle section of the inventive blank for the bottom section) is longitudinally and transversely incurvate and tapers to a point fore and aft, whereas the lateral walls (corresponding to the two marginal or lateral strips of the inventive bottom section) have a roughly constant (vertical) width and thus take on the longitudinal curvature of the bottom section.

The invention recommends making the blanks for the marginal or lateral strips roughly banana-shaped. In particular, the two longitudinal edges of a marginal or lateral strip of the bottom section of the sleeping bag can approach each other in their end regions, thus making it possible to achieve the desired sharp curvature in the transverse direction from the head region all the way to the foot region.

If the blanks for the marginal or lateral strips of the bottom section of the sleeping bag are separated from the blank for the flat region thereof adapted to the human body, either completely, or partially by means of cut-ins extending in the longitudinal direction of the blank in the regions of the transverse ends of the bottom section of the sleeping bag, the extent of the marginal or lateral strips can be chosen largely at will.

Attached to the lateral margins of the bottom section is a top section of the sleeping bag. This can be made from a plurality of blanks, which can be folded open to get in and out. The top section can then be provided with a zipper, a row of buttons or the like, extending in the longitudinal direction of the sleeping bag. On the one hand, this makes it easier to get in and out of the sleeping bag, and on the other hand makes it possible to influence the temperature inside the inventive sleeping bag. The contour of the top section as a whole preferably follows roughly the same contour as the reclining area, adapted to the human body, of the bottom section of the sleeping bag.

The top section of the sleeping bag can also either be removably attached, for example by means of snap fasteners or the like, so that the inventive sleeping bag can also be used like an ordinary hammock, or it can be non-removable, i.e. sewed on.

The invention is further optimized by disposing an insulating element, particularly an insulating pad, in the region of the bottom section of the sleeping bag. This insulating element is preferably made of a thermally insulating material, for example a foam fabric, and in the absence of sufficient mechanical strength should be kept largely free of tensile forces. On the other hand, this insulating element should fit as snugly as possible against the body of a sleeper, and to this end should be adapted to the preferred longitudinal and transverse curvature by an appropriate cut shape. When tensioners that pass through longitudinally are used for attachment, the insulating pad can be disposed either above or below them.

For the insulating pad to be removably attached, it can, for example, be insertable into a pocket-shaped receptacle on the underside of the bottom section of the sleeping bag or can be securable with buttons. In such cases the insulating pad can be removed for cleaning and other purposes.

A soft insert layer of cotton, down or the like is preferably provided above a fabric or tensioner layer that is part of the bottom section and absorbs the longitudinal tensile forces, or above an insulating means connected or integrated therewith. This increases the comfort of the sleeper. Like an insulating means made of foam fabric, this insert layer also cannot absorb any longitudinal tensile forces and must therefore be kept free therefrom by a fabric or tensioner layer.

Since particularly rope-shaped attaching elements are integrated with or connected to, particularly sewed to, the head and/or foot end of the bottom section of the sleeping bag, the primary lines of force can be fanned out two-dimensionally, thereby preventing pressure points during prolonged recumbency.

According to the teaching of the invention, two or more rope-shaped attaching elements are provided at the head end, the foot end, or both. This eliminates the need for spreader bars of the kind used in the prior invention, thereby straightening and thus removing the bends from the lines of force. What is achieved instead is a transverse incurvature of the suspended sleeping bag that begins at the branching points of the ropes, so that all of the sleeper's body parts that affect the center of gravity, including the regions of his head and feet, are positionally stabilized.

Passing the attaching rope through or under the bottom section of the sleeping bag makes it possible to keep the material of the bottom section of the sleeping bag largely free of strong tensile loads, thus minimizing the likelihood of tears. The attaching ropes can in this case be run through cavities or threaded through conduits or loops. It is impossible for tensioners run through such elements to shift laterally with respect to the bottom section of the sleeping bag, which additionally has a stabilizing effect on the suspended sleeping bag.

To further stabilize the sleeping bag and/or raise the top section thereof to make it easier to enter and exit, at least one tensioning means can be attached to the head and/or foot end of the top section of the sleeping bag. This tensioning means, particularly rope, need not be combined with the other attaching elements, particularly attaching ropes, but can be run directly to the attachment point concerned or to a still higher anchoring point, so that it extends as rigidly as possible from the sleeping bag. Any lateral tipping movement of the suspended sleeping bag causes this tensioning means to tighten and thereby produces a stabilizing restoring force.

Further features, details, advantages and effects deriving from the invention will become apparent from the following description of a preferred embodiment of the invention and by reference to the drawing. Therein:

The inventive suspended sleeping bag 1 is composed of a top section 2 of the sleeping bag, a bottom section 3 of the sleeping bag, and, disposed at the head and foot ends, tensionable attaching elements in the form of attaching ropes 4, 5.

Figure 2:
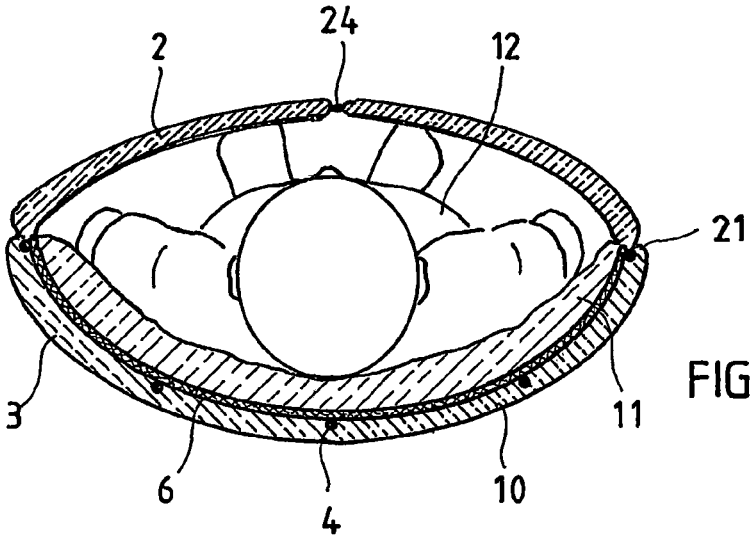
FIG. 2 is a cross section through the head portion of the suspended sleeping bag from FIG. 1.

As can be inferred from FIG. 2, in this embodiment the bottom section 3 of the sleeping bag comprises three layers. In the middle is a fabric layer 6, preferably made of a tear-resistant material such as nylon or the like. Provided at this fabric layer 6 are conduits 7 extending in the longitudinal direction of the sleeping bag 1 and through which continuous attaching ropes 4, 5 are to be drawn, and which can be formed, for example, by sewing the longitudinal edges 8 of tapes 9 to the top or bottom face of fabric layer 6.

Extending under fabric layer 6 is a layer 10 of thermally insulating material, preferably an elastic foam fabric. This insulating layer 10 can be either permanently glued or sewed to the bottom face of fabric layer 6 or removably fastened to it, for example by means of buttons or snap fasteners. This layer 10 can also be omitted or integrated with fabric layer 6. It can also be disposed above fabric layer 6.

Above fabric layer 6, a soft layer 11, for example an insert layer filled with down or the like, serves to ensure a comfortable recumbent position for a sleeper 12.

Figure 3:
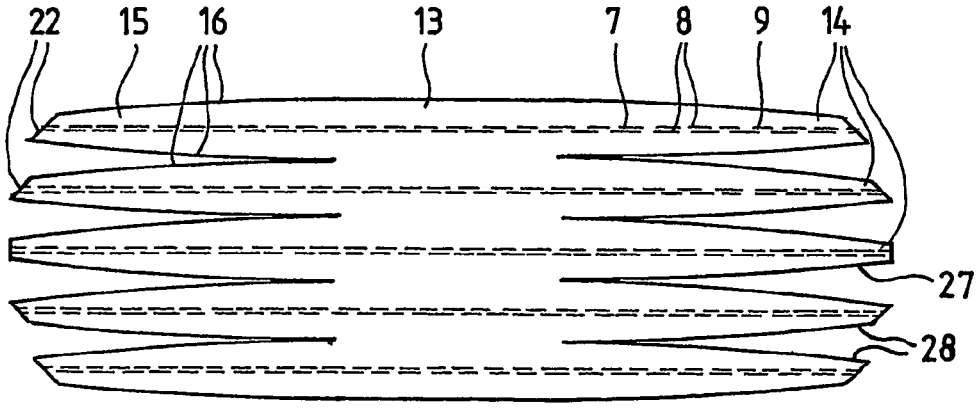
FIG. 3 is a blank for the bottom section of the sleeping bag from FIGS. 1 and 2.

As FIG. 3 shows, the bottom section 3 of the sleeping bag, or at least the fabric and/or insulating layer 6, 10 thereof, is formed from a blank 13 comprising a plurality of gores or strips 14 that preferably extend roughly parallel to one another. These each taper to their respective ends 15, preferably along convex longitudinal edges 16. The gores or strips 14 can either be cut so as to be completely separate from one another or can be joined for example in the middle, with cut-ins 27 at the ends, as can be seen in FIG. 3. With the edges 28 of these cut-ins 27 each following a convex line, sewing adjacent strips 14 together along these edges 28 produces the desired (viewed from above) doubly concave curvature of bottom section 3 of the sleeping bag. Extending roughly along the middle of each strip 14 is a conduit 7 through which a respective attaching rope 4, 5 is to be drawn.

Figure 1:
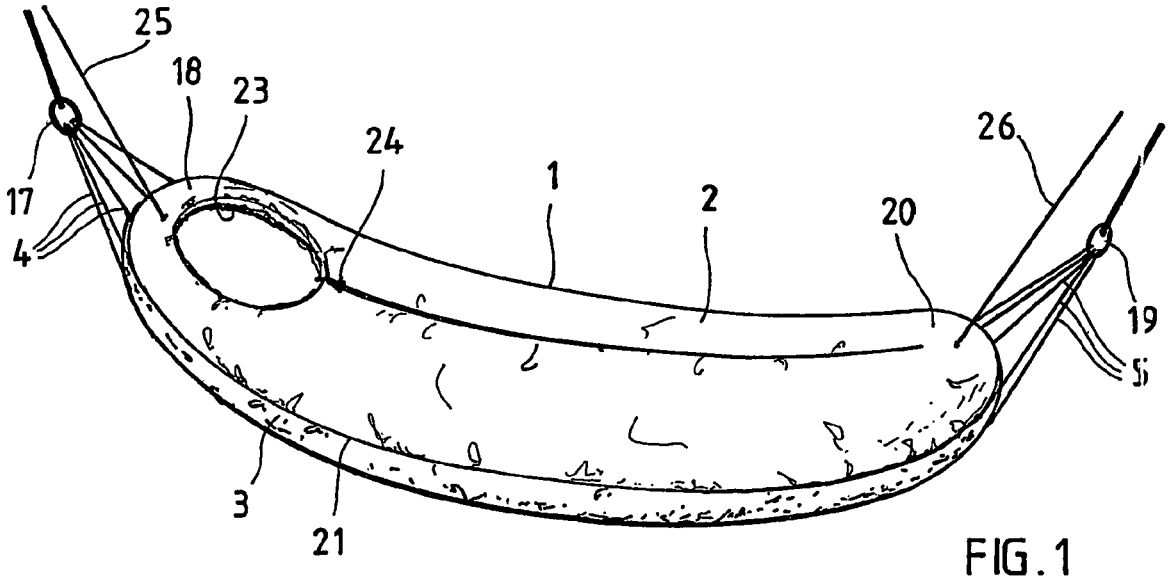
FIG. 1 is a perspective view of an inventive suspended sleeping bag.

As can be recognized from FIG. 1, the attaching ropes 4, 5 extend continuously from a, for example, ring-shaped gathering element 17 at the head end 18 of the suspended sleeping bag 1 to an analogous gathering element 19 at its foot end 20. In order for the bottom section 3 of the sleeping bag to be able to form the double curvature in the longitudinal and transverse directions depicted in FIGS. 1 and 2, the attaching ropes 4, 5 extending along its longitudinal lateral edges 21 must be shorter than the attaching ropes 4, 5 respectively extending closer to the vertical longitudinal center plane of the sleeping bag 1. In the case of the total of five attaching ropes 4, 5 extending along bottom section 3 of the sleeping bag depicted in the drawing, the outermost are therefore the shortest; the middle one is much longer. Ropes 4, 5 located between them are in any event longer than those extending along the longitudinal lateral edges 21, and may even be longer than the middle rope 4, 5. In order for the bottom section 3 of the sleeping bag to adapt to the double curvature with as few wrinkles as possible, the length of the strips 14 of blank 13 should decrease from its longitudinal center line to the lateral edges. So that adjacent strips 14 that are to be sewn together can still be assembled without difficulty, adjacent longitudinal edges 16 of different strips 14 should each have the same length, thus cumulatively resulting in the blank 13 illustrated in FIG. 3, where the cut ends 22 of the gores 14 are slanted with respect to the longitudinal axis of the blank.

The top section 2 of the sleeping bag only has to be composed of one layer, but can be implemented for example in the manner of a pillow with a thermally insulating fill. It can further be fabricated from two layers having different properties, for example a stabilizing layer that can, for example, have a reticular character and an outer insulating layer that can optionally be accoutred or suitably coated to make it water-repellent. The insulating layer can be removably connected to the stabilizing layer, for example by means of zippers, hook and pile fasteners or snap fasteners, so that the insulating layer can be folded open or removed as necessary to prevent heat accumulation.

Since top section 2 need not replicate the double curvature of bottom section 2, it can be fabricated from a single, continuous blank.

Provided in top section 2 in the region of the head end 18 is a face opening 23 to allow a sleeper 12 to breathe. In order for the face opening 23 to approximately retain its shape even when top section 2 is under tension, there can be provided along the margin thereof a reinforcing element made of a solid but flexible material, for example plastic, or for example in the form of a flexible fiberglass rod. The reinforcing element can be implemented as ring- or C-shaped and also, if appropriate, as length-adjustable. For connection with the top section 2 of the sleeping bag, the reinforcing element can be disposed in a conduit extending around face opening 23. In this case it is preferably secured by one end, while a stopper element is slidably pushed onto the other end and can be locked in any position. If its cross section is larger than the cross section of the conduit, it can be used similarly to a drawstring to define the cross section of the face opening 23. Finally, face opening 23 can be provided with a covering, for example in the form of mosquito netting or the like.

To make it easier to get in and out of the suspended sleeping bag 1, the top section 2 is further provided with a longitudinally and preferably centrally extending zipper 24. There also can be an emergency exit, which can be disposed along the cross section of the sleeping bag, preferably staggered by about 90°. This can be a second zipper or a hook and pile fastener or the like.

Top and bottom sections 2, 3 can be sewed together along their edges 21, but a detachable connection could also be provided, for example comprising a circumferentially extending zipper or a row of buttons or snap fasteners, so that the sleeping bag 1 can be converted into an ordinary hammock.

As FIG. 1 further shows, an additional rope 25, 26 acts on top section 2 in the region of each of the head and foot ends 18, 20, respectively. The purpose of these ropes is to (further) stabilize the suspended sleeping bag 1 against the tendency to tip sideways. These ropes 25, 26, must not be united with the other attaching ropes 4, 5 at gathering elements 17, 18, but instead are run directly to the attachment point proper, for example a tree trunk or the like, or are anchored still higher, so that they extend as rigidly as possible. Should the sleeping bag 1 tend to tip, the stabilizing ropes 25, 26 are stretched taut and hold the sleeping bag 1 in the horizontal alignment shown in FIGS. 1 and 2. This can be necessary if the attachment points are far apart and there is consequently little sag in the attaching ropes 4, 5, or in the case of corpulent individuals with a high center of gravity.

Figure 4:
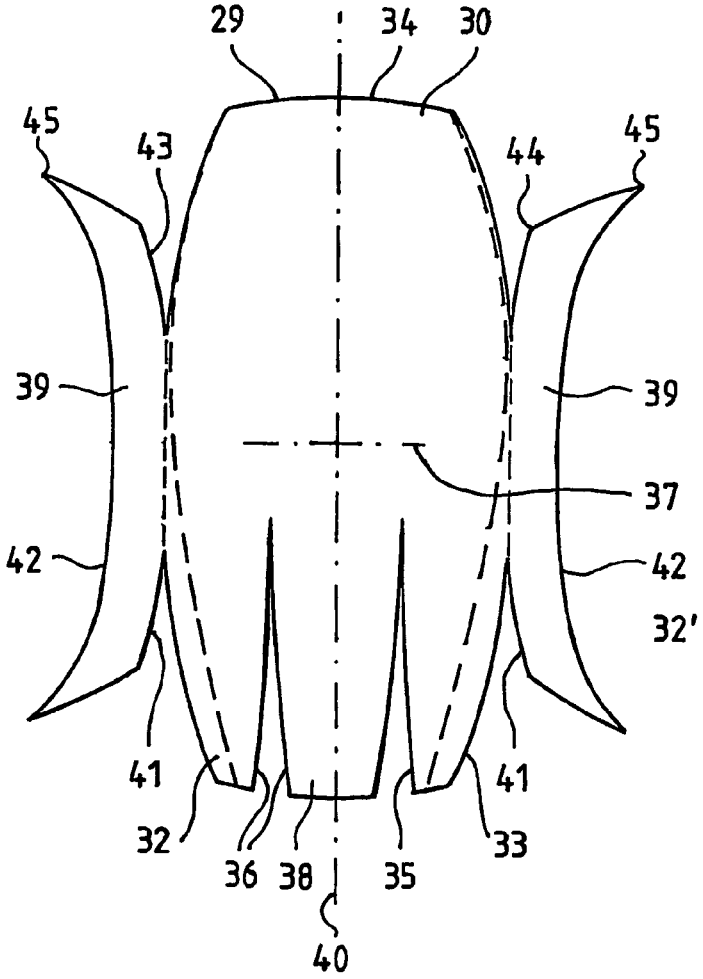
FIG. 4 is a blank for the bottom section of another embodiment of an inventive suspended sleeping bag.
Figure 5:
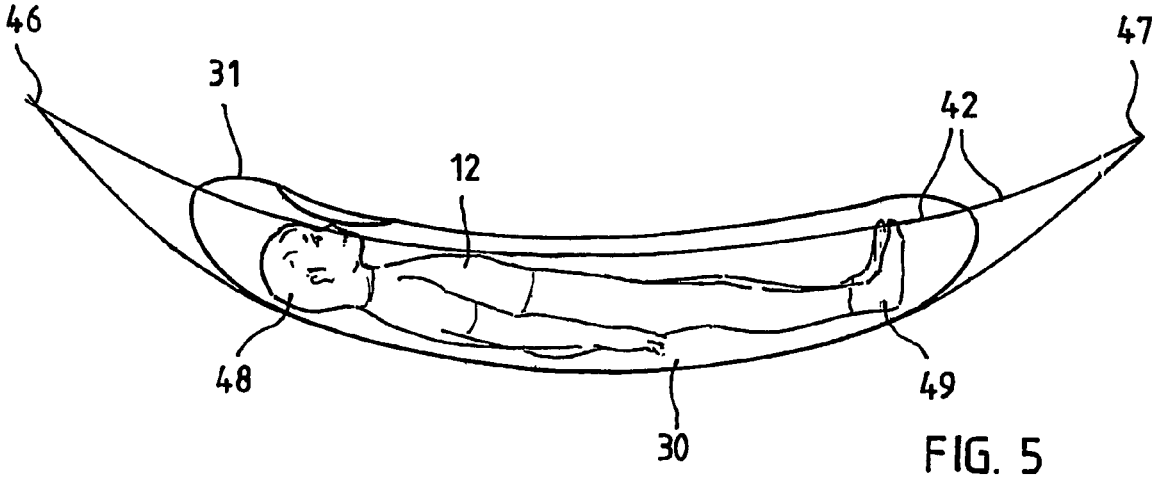
FIG. 5 is a side view of a suspended sleeping bag whose bottom section is made from the blank according to FIG. 4.

Reproduced in FIG. 4 is an optimized blank 29 for a bottom section 30 of a very stable suspended sleeping bag 31, which is depicted in FIG. 5. Apparent is a middle section 32 with a roughly spindle-shaped outline whose shape is adapted to the geometry of a human body. In the use position, this middle section 32 forms the reclining area proper for the sleeper 12. A blank of this kind makes it possible to adapt to the body shape of a sleeper 12. It is also possible, if necessary, to use a blank that extends asymmetrically to a transversely oriented center line 37, in keeping with the broader structure of the body in the region of the chest as opposed to that of the legs.

The middle section 32 thus is bounded by two convex longitudinal edges 33 and two preferably also convex transverse ends 34. An option in such cases is to provide the middle section 32 with cut-ins 35 that proceed from one or preferably both transverse ends 34 and whose edges 36 converge toward each other in the direction of the transverse center axis 37 of the blank 29 and preferably extend along convex lines. These cut-ins 35 can also extend all the way to the center axis 37, the strips 38 remaining between them being made completely separate from one another. The two edge lines of the cut-in 35 per se have roughly the same length in each case and can thus be sewn together without any surplus.

Whereas blank 32 replicates a pure spindle shape, the blank for an alternative middle section 32', reflected in broken lines, has a shape adapted to the human body. It will be appreciated that this is no longer symmetrical with respect to a transverse center axis 37. Instead, the blank 32' is broadest in the region of a person's shoulders, i.e., in the half at the head end, and narrows continuously toward the feet. The body of a sleeper is thereby always afforded an adequate reclining area, which has the effect of promoting a flat position (viewed in the longitudinal direction of sleeping bag 1).

Blank 29 additionally comprises, adjacent the longitudinal edges 33 of middle section 32, two marginal or lateral strips 39 that are disposed symmetrically with respect to a longitudinal center axis 40 of the blank.

These two marginal or lateral strips 39 have roughly the shape of a banana or an outwardly opening parenthesis, so that the arrangement as a whole roughly assumes the shape )O(. These marginal or lateral strips 39 are also separated from the middle section 32 by cut-ins 41, which in the extreme case can extend all the way to the transverse center axis 37, that is to say if the lateral strips 39 are cut so as to be completely separate.

As can be gathered from FIG. 4, the respective outwardly disposed marginal curves 42 of the lateral or marginal strips 39 are concavely curved, and the width of these strips 39 is roughly constant in the middle section near transverse center axis 37. Roughly at a distance from this center axis 37 that is equal to approximately one-third of the total length of the blank 29, the radius of curvature at the outer edge 43 of the cut-in 41 decreases; in the extreme case, there is at that location an outward bend 44, for example with an angle of 30° to 45°, so that from that point on the longitudinal edges 42, 43 of a lateral strip 39 converge sharply and ultimately approach each other or in the extreme case meet to form an outward-pointing vertex 45. Instead of the bend 44, an edge region with a small radius of curvature can also be provided.

Due to the described shape of the lateral strips 39, their outwardly disposed longitudinal edges 42 are much shorter than the inner edges 43 that are each to be sewn to middle section 32. On the other hand, the lines extending along these inner edges 43 are also longer than the longitudinal center line between the attachment points 46, 47; they are, in fact, the longest lines extending along the bottom section 3 of the sleeping bag between attachment points 46, 47. After the two (roughly equal-length) edge lines of a cut-in 41 have been sewn together, the bottom section 30 accordingly assumes roughly the shape of a gondola, if the path of the outer edges 42 is not straightened by stretching the suspended sleeping bag 31 between two attachment points 46, 47, as can be seen in FIG. 5. As a result thereof, the reclining area corresponding to middle section 32 sags greatly in the region near the attachment points 46, 47, so that the head 48 and feet 49 of the sleeper 12 lie markedly below lateral edge 42 and therefore assume a stable and, moreover, extremely comfortable position.

The invention claimed is:

1. A suspended sleeping bag (1; 31) with a top and a bottom section (2, 3; 30) and with attaching elements at head and foot ends (18, 20) that converge toward each other in a region of a gathering point (17, 19) at each of the head and the foot ends (18, 20), particularly in the form of ropes (4, 5), cords, tapes, pieces cut from a web of fabric, or another tear-resistant material, for the purpose of attachment at two mutually spaced apart attachment points (46, 47), the bottom section (3; 30), unlike the top section (2), absorbing tensile forces in a longitudinal direction and conveying them to the attachment points (46, 47) along lines that converge in an approximately ray-like manner in the region of one or the other of the gathering or attachment points, wherein (a) the bottom section (3; 30) of the sleeping bag is so cut to shape and the a length or cut shape of the attaching elements (4, 5) is so calculated that a line extending along a periphery of the bottom section (3; 30) of the sleeping bag from one gathering point (17) to the other gathering point (19) is shorter than a line extending (roughly) centrally along or through the bottom section (3; 30) of the sleeping bag between said gathering points (17, 19); and (b) the top section (2) of the sleeping bag is connected to lateral edges of the bottom section (3; 30) of the sleeping bag.

2. The suspended sleeping bag (1; 31) as recited in claim 1, wherein the line extending along the periphery of the bottom section (3; 30) of the sleeping bag between the one gathering point (17) and the other gathering point (19) is free of bends.

3. The suspended sleeping bag (1; 31) as recited in claim 1, wherein the bottom section (3; 30) of the sleeping bag is cut to shape and the length of the attaching elements (4, 5) is such that between the periphery of the bottom section (3; 30) of the sleeping bag and a longitudinal center line thereof there is a line with no bends or undulations, extending along or through the bottom section (3; 30) of the sleeping bag from the one gathering point (17, 19) to the other, which is at least the same length as all other lines extending along and through the bottom section (3; 30) of the sleeping bag between the gathering points (17, 19).

4. The suspended sleeping bag as recited in claim 3, wherein a flat region (32) enclosed by two generally mutually symmetrical, longest regions of the bottom section (3; 30) of the sleeping bag has a shape adapted to the human body.

5. The suspended sleeping bag as recited in claim 4, wherein a broadest point of the flat region (32) adapted to the human body is located substantially at a height of a sleeper's shoulders and is shifted to the upper or head half of the suspended sleeping bag.

6. The suspended sleeping bag as recited in claim 4, wherein the flat region (32) adapted to the human body has longitudinal edges (33) that are at least regionally convex.

7. The suspended sleeping bag as recited in claim 6, wherein the bottom section (30) of the sleeping bag, in the region of the periphery thereof, adjacent to each of the longitudinal edges (33) of the flat region (32) adapted to the human body, is connected to at least one marginal strip (39) whose peripheral boundary (42) follows a concave path.

8. The suspended sleeping bag as recited in claim 7, wherein blanks for the marginal strips (39) are generally banana-shaped.

9. The suspended sleeping bag as recited in claim 8 wherein the blanks (29) for the marginal strips (39) of the bottom section (30) of the sleeping bag are separated from a blank for the flat region (32) thereof adapted to the human body, at least partially by means of cut-ins (41) extending in a longitudinal direction (40) of the blank (29) in the region of transverse ends (34) of the bottom section (30) of the sleeping bag.

10. The suspended sleeping bag as recited in claim 7 wherein two longitudinal edges (42, 43) of the marginal strip (39) of the bottom section (30) of the sleeping bag approach each other in end regions thereof.

11. The suspended sleeping bag as recited in claim 4 wherein the top section (2) of the sleeping bag and all blanks therefore collectively have a contour that generally corresponds to the flat region (32) of the bottom section (30) of the sleeping bag.

12. The suspended sleeping bag as recited in claim 4, wherein disposed in the region of the bottom section (3; 30) of the sleeping bag is an insulating pad (10).

13. The suspended sleeping bag as recited in claim 12, and further comprising a pocket-shaped receptacle on an underside of the bottom section (3; 30) of the sleeping bag for receiving the insulating pad (10).

14. The suspended sleeping bag as recited in claim 13, wherein the insulating pad (10) is removably attached to a load-bearing fabric.

15. The suspended sleeping bag as recited in claim 14, wherein provided above the load-bearing fabric and/or above the insulating pad (10) is a soft insert.

16. The suspended sleeping bag as recited in claim 1, wherein the bottom section (3; 30) of the sleeping bag comprises, outside of the reclining area for a person at at least one of the head and foot ends (18, 20), a generally trapezoidally tapering cut shape of a tear-resistant material, whose broader main face is disposed on a region serving as a sleeping bag and whose narrower face is provided with an attaching means comprising at least one of a rope, hook and eye.

17. The suspended sleeping bag as recited in claim 1, wherein the attaching elements (4, 5) are connected to the head and/or foot end (18, 20) of the bottom section (3; 30) of the sleeping bag.

18. The suspended sleeping bag as recited in claim 1, wherein more than two attaching ropes (4, 5) are provided at at least one of the head and foot ends (18, 20).

* * * * *